US008196593B2

(12) United States Patent
Schessl et al.

(10) Patent No.: US 8,196,593 B2
(45) Date of Patent: Jun. 12, 2012

(54) CUTLERY BASKET FOR A DISHWASHER AND DISHWASHER

(75) Inventors: Bernd Schessl, Dillingen (DE); Rainer Schütz, Neresheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 429 days.

(21) Appl. No.: 12/515,311

(22) PCT Filed: Nov. 5, 2007

(86) PCT No.: PCT/EP2007/061888

§ 371 (c)(1),
(2), (4) Date: May 18, 2009

(87) PCT Pub. No.: WO2008/061868

PCT Pub. Date: May 29, 2008

(65) Prior Publication Data

US 2010/0078048 A1 Apr. 1, 2010

(30) Foreign Application Priority Data

Nov. 23, 2006 (DE) ..... 10 2006 055 352

(51) Int. Cl.
*B08B 3/02* (2006.01)

(52) U.S. Cl. ..... 134/135; 211/41.3

(58) Field of Classification Search ..... 134/135; 211/41.3

See application file for complete search history.

(56) References Cited

U.S. PATENT DOCUMENTS

| | | | | |
|---|---|---|---|---|
| 1,373,975 | A * | 4/1921 | Riddle | 211/41.6 |
| 3,146,045 | A * | 8/1964 | Kauffman | 312/229 |
| 3,486,804 | A * | 12/1969 | Kauffman et al. | 312/228.1 |
| 3,556,625 | A * | 1/1971 | Kauffman | 312/301 |
| 3,752,322 | A * | 8/1973 | Fiocca et al. | 211/41.8 |
| 5,344,029 | A * | 9/1994 | Oghia et al. | 211/41.8 |
| 5,462,348 | A * | 10/1995 | Ellingson et al. | 312/301 |
| 5,649,630 | A * | 7/1997 | Remmler | 211/41.8 |
| 6,325,220 | B1 * | 12/2001 | Malmstrom | 211/41.8 |
| 7,231,929 | B2 * | 6/2007 | Landsiedel et al. | 134/135 |
| 7,445,128 | B2 * | 11/2008 | Kaczmarek | 211/41.8 |
| 7,455,066 | B2 * | 11/2008 | Feddema et al. | 134/56 D |
| 7,493,905 | B2 * | 2/2009 | Jeong et al. | 134/56 D |
| 7,862,664 | B2 * | 1/2011 | Choi et al. | 134/56 D |
| 7,931,155 | B2 * | 4/2011 | Bastuji | 211/41.9 |
| 2007/0039636 | A1 * | 2/2007 | Egger et al. | 134/56 D |

FOREIGN PATENT DOCUMENTS

| | | |
|---|---|---|
| DE | 1910245 | 11/1969 |
| EP | 0186157 B1 | 5/1989 |
| EP | 1275336 A1 | 1/2003 |
| EP | 1384431 A3 | 2/2006 |
| EP | 1136030 B1 | 6/2009 |

OTHER PUBLICATIONS

Euorpean Patent Office 1 275 336 Jan. 2003.*
European Patent Office 1 384 431 Jan. 2004.*

* cited by examiner

*Primary Examiner* — Frankie L Stinson
(74) *Attorney, Agent, or Firm* — James E. Howard; Andre Pallapies

(57) ABSTRACT

A dishwasher including at least one cutlery basket for accommodating cutlery items in a horizontal position, wherein the at least one cutlery basket is adjustable at least in sections, and wherein the at least one cutlery basket includes a first subsection having an adjustable clearance height, and a second subsection having an adjustable clearance height.

26 Claims, 2 Drawing Sheets

CUTLERY BASKET FOR A DISHWASHER AND DISHWASHER

The invention relates to a cutlery basket for a dishwasher, said cutlery basket being embodied to accommodate cutlery items in an essentially horizontal position and having a base section for holding the cutlery items. The invention further relates to a dishwasher, in particular a domestic dishwasher, having devices for washing dishes.

BACKGROUND OF THE INVENTION

A cutlery basket for accommodating cutlery items in a horizontal position is known from EP 0 186 157 B1. The dishrack described there is embodied as a drawer and offers the possibility of accommodating conventional items of cutlery, such as knives, spoons, forks etc. and storing them in a position that is favorable for the effectiveness of the wash program. In order to optimize the use of the limited space in the washing compartment, the height of the cutlery drawer is chosen such that spoons having a large bowl of a standard set of cutlery can be stored therein without difficulty. Cutlery items having greater dimensions, such as e.g. serving cutlery, ladles etc., cannot be placed in the cutlery drawer because the dimensions of the cutlery items prevent the cutlery drawer from being inserted into the dishwasher. Said cutlery items must either be washed by hand or must be placed into the dishracks in such a way as to ensure that the washing liquid can also reliably drain away.

A generic cutlery basket is known from WO 03/055375 A1. In its base section said cutlery basket has at least one swivel joint which is arranged and embodied in such a way that at least one subsection of the base section can be swiveled relative to a remaining section of the base section. With said cutlery basket, at least two states can be distinguished. When standard cutlery items are used, these can be placed into the cutlery basket, with both the lowerable subsection and the remaining section of the base section lying on a plane, i.e. form an angle of 180° with one another. In this state the cutlery basket offers space for the cutlery items of a standard cutlery set as well as optimal use of the dishrack located directly thereunder. In a second state the lowerable subsection of the base section can be lowered by way of means such that the standard cutlery can be placed in the remaining section and in the subsection of the base section, and in addition in the lowered subsection there is enough space available for placing cutlery items having larger dimensions, without the likelihood of their colliding with the walls of the washing container.

SUMMARY OF THE INVENTION

The object of the present invention is to disclose a dishwasher having an improved cutlery basket for holding cutlery items in a horizontal position for use in a dishwasher, which cutlery basket, while allowing optimal use to be made of the space available in the washing compartment, can accommodate cutlery items having greater dimensions for washing purposes and at the same time delivers good cleaning and drying results.

This object is achieved by the subject matters having the features of the independent claims. Advantageous embodiments of the invention are set forth in the dependent claims.

A dishwasher according to the invention has a cutlery basket which is embodied for accommodating cutlery items in a horizontal position and whose clearance height is adjustable in a first subsection. It is provided according to the invention in this case that the clearance height can be adjusted at least in sections at least in a second subsection of the cutlery basket. Flexibility is increased as a result of this measure.

In this case it is preferably provided that in the region of the first and second subsections the clearance height can be adjusted independently of each other such that if necessary the two sections can have a different clearance height.

In a preferred embodiment it is provided that the adjustment is made by way of a swiveling movement of the first and second subsections. For this purpose the two subsections can be connected by means of a swivel joint.

It is furthermore preferably provided that the clearance height can be adjusted in the region of the entire cutlery basket surface area, e.g. by simultaneous adjustment of the first and second subsections.

The first subsection and second subsection are preferably connected to each other in a swivelable manner by means of a swivel joint. It is furthermore provided that the swivel joint is arranged in the base section, with the first and second subsections in each case being swivelable independently of each other and/or jointly swivelable about the swivel joint. When the cutlery basket according to the invention is used, at least four states of said inventive cutlery basket can be differentiated. In this case, according to the particular situation, the cutlery basket provides a greater amount of height either completely or partially (i.e. in one of the subsections) for cutlery items that are to be sorted in the cutlery basket or a greater amount of height either completely or partially for a dishrack disposed thereunder in the dishwasher. The cutlery basket offers sufficient space for the cutlery items of a standard cutlery set as well as, in addition, optimal use of the dishrack located directly thereunder. On the other hand, however, the cutlery basket also allows cutlery items having greater dimensions to be placed in it without the likelihood of their colliding with washing compartment walls. A particularly high degree of flexibility is achieved as a result of the fact that the first and second subsections are embodied as swivelable separately from each other.

According to one embodiment, a first swivel joint is provided about which the first and second subsections can be swiveled in each case between a first and second operating position, wherein the swivel joint is arranged between a first and a second side edge of the base section, the second side edge running parallel to the first. The first or second subsection preferably lies in each case in an essentially horizontal plane in the first operating position and in a plane tilted at an acute angle to the horizontal plane in each case in a second operating position. When the first and second subsections are both in the first operating position, they assume an angle of roughly 180° relative to each other, such that a level surface is formed in the base section of the cutlery basket. If both the first and the second subsections are in the second operating position, then the base section runs essentially completely transversely or in an arc relative to the horizontal plane in which a first and, running parallel thereto, a second side edge of the base section are arranged. As a result the first and second subsections are disposed at an obtuse angle relative to each other. This causes the cutlery items to assume an inclined position both in the first and in the second subsection of the base section, thereby improving the manner in which water drains away from the cutlery items during the drying process. This means that less energy is required for the drying process compared to cutlery baskets in which the cutlery items are stored in an essentially horizontal position. The result is maximum use of available space at the same time as maximum flexibility. With this arrangement the first and second subsections can be swiveled between the first and second operating position independently of each other. Further operating positions between the first and second operating position can also be provided.

A particularly simple embodiment in design engineering terms is produced if the first and second subsections are embodied as mirror-symmetrical.

In a further embodiment, at least a second swivel joint is provided which is disposed in the first and/or second side edge and enables the first and second subsections to be swiveled jointly, in particular independently of a swiveling of the first and second subsection relative to the first swivel joint. If a second swivel joint is provided both on the first and on the second edge, it becomes possible to lower the cutlery basket, thereby providing a simple height adjustment. The height adjustment is achieved by a respective swiveling relative to the two second swivel joints.

The cutlery basket is beneficially embodied as a flat insert with or without runner wheels and consists of a frame as well as of two inserts, preferably in the form of wide-meshed strainer inserts, which are swivelable relative to each other. These can be removed from the frame, the two inserts forming the first and second subsections of the base section. The embodiment as a flat insert is to be understood as an embodiment of the cutlery basket in the sense of a cutlery drawer.

The inserts beneficially have the shape of a wedge in cross-section in each case, as a result of which the cutlery basket and/or the inserts in question have an increased dimensional stability. The side edges of the inserts can herein also be embodied in the form of a wide-meshed strainer insert. It is also conceivable to form the side edges from solid material. The inserts preferably consist of a plastic suitable for injection molding, if necessary with integrated reinforcements made of metal or the like.

In a further embodiment means are provided in each case on the lowerable first and second subsections of the base section, said means enabling the first and second subsection to be fixed in the predefined operating positions. The means are embodied for the purpose of preventing the first and/or second subsection from being lowered beyond a certain angle.

According to one embodiment the means are formed by a latching hook which can be brought into engagement with the frame. According to another embodiment the means are formed by a profile wire which is swivelable relative to the inserts and a guiding means arranged on the inserts, wherein the profile wire can be supported at various points on the frame in order to provide one of the operating positions of the cutlery basket. In principle the embodiment of the means can be arbitrary provided it is ensured that the first and second subsection can be fixed in the predefined operating positions.

A dishwasher according to the invention includes a cutlery basket as described above. The cutlery basket is mounted and guided in a retractable manner similar to a drawer, preferably above a, preferably top, dishrack in a washing chamber of the dishwasher. For an optimized use of the space in the washing chamber provided by the dishwasher it is beneficial if the cutlery basket directly abuts with its upper cutlery edge against a roof of the washing compartment of the dishwasher.

The present invention has succeeded in providing a cutlery basket for holding cutlery items in a horizontal position which for washing purposes can when necessary accommodate cutlery items having larger dimensions or even smaller items to be washed, while at the same time making optimal use of the washing compartment and improving the drying properties of the items to be washed that are stored in the cutlery basket.

BRIEF DESCRIPTION OF THE DRAWINGS

A preferred embodiment of the present invention is explained in more detail below with reference to the drawings, in which.

DETAILED DESCRIPTION OF THE EXEMPLARY EMBODIMENTS OF THE PRESENT INVENTION

Figure 1:
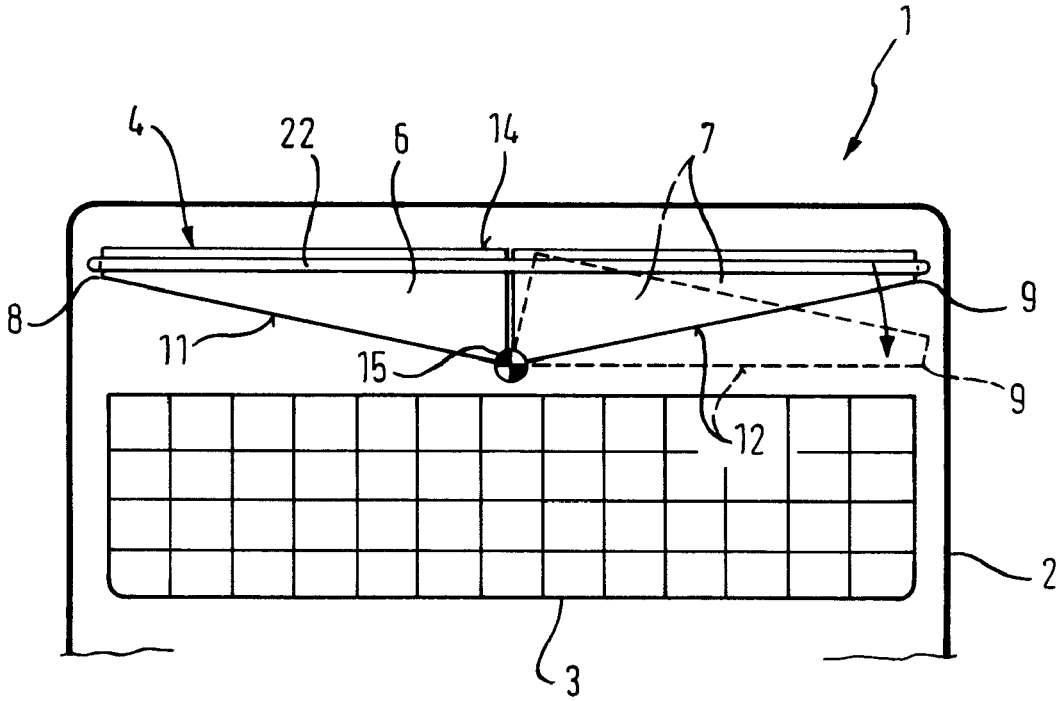
FIG. 1 shows a front view in a dishwasher having a cutlery basket according to the invention.

In the arrangement according to FIG. 1, a front-loading dishwasher 1 having a washing compartment 2 is shown, said dishwasher having a top dishrack 3 in a known manner. The latter is assigned, likewise in a known manner, a spray arm (not shown in the figure) which is typically provided below the dishrack 3. Arranged above the dishrack 3 is an inventive cutlery basket 4 which consists of two inserts 6, 7 embodied as wedge-shaped and swivelable about a swivel joint 15, and a frame 22 in which the inserts 6, 7 are mounted. The frame 22 can be formed from a continuous wire strut made of metal and if necessary further supporting struts.

The inserts 6, 7 are preferably produced from a plastic and embodied in the form of wide-meshed strainer inserts so that washing liquid can enter or exit through the recesses located in the respective base section. In the exemplary embodiment the inserts 6, 7 are embodied as mirror-symmetrical and in the exemplary embodiment have a shape narrowing toward side edges 8, 9 of the base section. The base section of the cutlery basket 6 is formed by respective subsections 11, 12 of the inserts 6, 7.

Each of the inserts 6, 7 and hence each of the subsections 11, 12 is swivelable independently of the other about the swivel joint 15 between a first operating position, in which the subsection in question assumes an essentially horizontal position (cf. the insert 7 indicated by the broken line), and a second operating position, in which the subsection in question is tilted at an acute angle relative to the horizontal. This is represented in FIG. 1 for the insert 7 by means of the unbroken line. If both inserts 6, 7 are located in the second operating position, this produces a base section of the cutlery basket 4 in which the first and second subsections 11, 12 are arranged at an obtuse angle relative to each other. This results in the cutlery items assuming a slanted attitude wherein spoons, for example, are stored with their bowls oriented in the direction of the swivel joint 15. By this means it is ensured that cutlery items having larger dimensions also do not project beyond a top cutlery basket edge 14. This useful height present in the region of the swivel joint can be provided in the entire cutlery basket 4 if the inserts 6, 7 or subsections 11, 12 are tilted into the first operating position, in which the subsections 11, 12 lie in a common plane. In this way it is even possible to arrange smaller items of dishware, such as e.g. cups, in the cutlery basket.

All in all, the invention also allows the cutlery basket 4 to abut directly against a roof of the washing compartment 2 of the dishwasher 1 with its upper cutlery basket edge 14. As a result a large usable space is made available to the dishrack disposed under the cutlery basket 4.

In the exemplary embodiment according to FIG. 1, the cutlery basket 4 according to the invention has only one swivel joint 15 which is arranged centrally between the side edges 8 and 9. A variant in which additional swivel joints are arranged in the region of the side edges 8, 9 is not shown. A tilting about said swivel joints in each case enables the cutlery basket 4 to be lowered while completing a Z-shaped movement. As a result a greater amount of height can be made available to the cutlery basket 4, thereby enabling smaller items of dishware also to be stored in the cutlery basket 4 when necessary, in addition to or instead of cutlery items sorted horizontally. Irrespective of the tilting about the further swivel joints it is still possible in this case for the inserts 6, 7 to be swivelable about the swivel joint 15 shown in FIG. 1. With this variant there is thus produced a plurality of different operating positions which can be chosen by a user of the dishwasher 1 according to requirements.

The invention is furthermore not restricted to the symmetrical embodiment of the cutlery inserts 6, 7, although this is the most beneficial. Rather, the swivel joint 15 can be arranged at an arbitrary position between the side edges 8, 9, the embodiment and size as well as shape of the inserts 6, 7 then being tailored accordingly.

Figure 2:
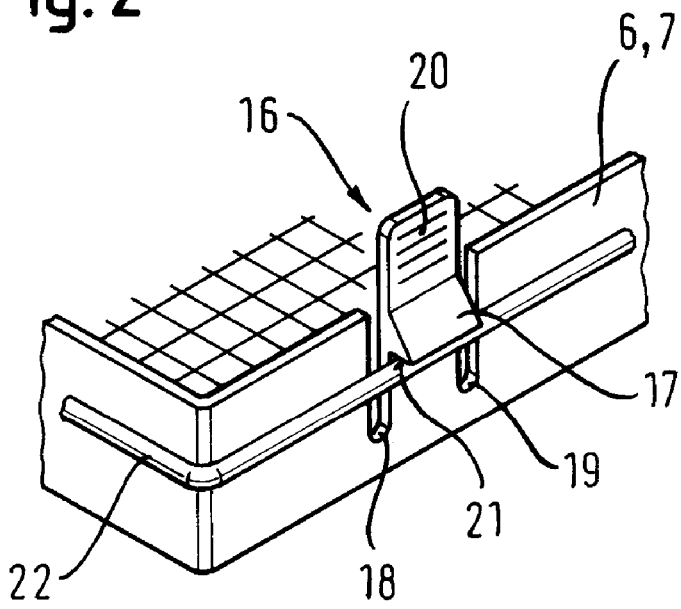
FIG. 2 shows a perspective view of a means for fixing a first or second subsection of a base section of the cutlery basket in a predefined operating position according to a first exemplary embodiment.
Figure 3:
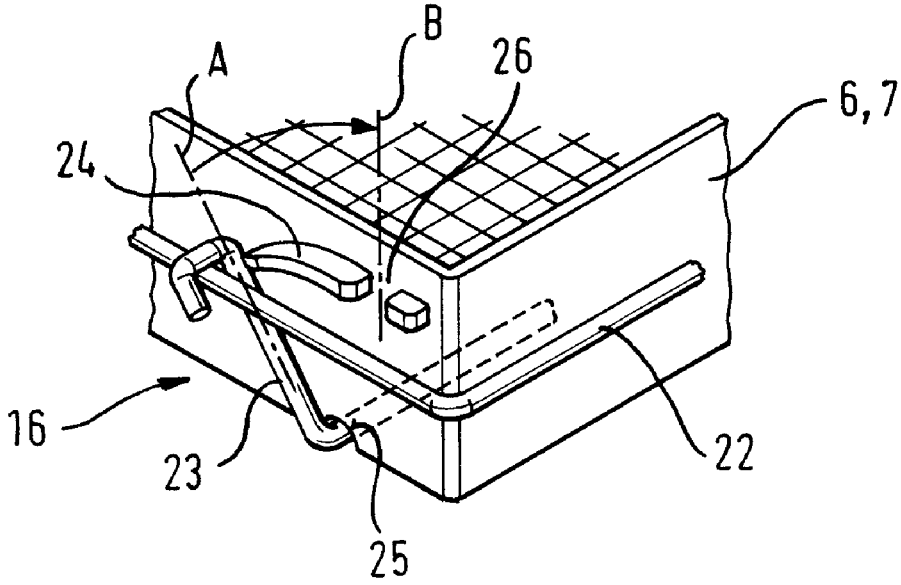
FIG. 3 shows a perspective view of a means for fixing a first or second subsection of a base section of the cutlery basket in a predefined operating position according to a second exemplary embodiment.

In order to enable the inserts 6, 7 to be fixed in the operating positions provided, fixing means are provided in each case to assume this task. Two exemplary embodiments illustrating this are shown in FIGS. 2 and 3. A perspective view of a section of one of the inserts 6, 7 is shown in each case, together with the fixing means.

In each case the fixing means 16 beneficially interact with the sections of the frame 22 lying in the region of the side edges 8, 9. This is not mandatory, however.

In the exemplary embodiment according to FIG. 2, the means 16 is formed by a latching hook 17. This is flexibly deformable by means of respective cutouts 18, 19 in a sidewall of the insert 6, 7. Embodied on the latching hook 17 is a shoulder 21 which can rest on a section of the frame 22. In order to release the fixing position shown, the latching hook can be deformed at an actuating surface 20 in the exemplary embodiment in the direction of the interior of the insert 7, thereby enabling the insert 6, 7 to be lowered relative to the position shown. In the lowered position the fixing can be implemented for example by a stopping means (not shown).

In the exemplary embodiment according to FIG. 3, the means 16 is formed by a profile wire 23 which is routed and rotatably mounted in parallel with a section of the frame 22 in a cutout 25, e.g. in the form of a slot or groove. The profile wire 23 can be tilted between a first position A and a second position B, the positions A and B being defined by a guide means 24 which is embodied on a side edge of the insert 6, 7. The definition can be formed for example by one (or also more) recess(es) in the guide means 26. In each of the two positions A, B, a section of the profile wire 23 bent through 180° embraces a section of the frame 22, with the result that the insert 6, 7 comes to rest in the first, lowered, or second, non-lowered, operating position, according to the position A or B of the profile wire.

By means of the present invention a cutlery basket and a dishwasher are provided which permit maximum use of space for the cutlery basket and a dishrack disposed thereunder. The cutlery basket can accommodate cutlery items having larger dimensions as well as small items of dishware for washing, wherein in one operating position the washing liquid drains away in an improved manner owing to cutlery items lying at a slant. Less energy for the drying process is required as a result. On the other hand, a completely flat base section of the cutlery basket can be provided, wherein owing to a plurality of swivel joints being provided it is even made possible to lower the cutlery basket.

LIST OF REFERENCE SIGNS

1 Dishwasher
2 Washing compartment
3 Dishrack
4 Cutlery basket
6 Insert
7 Insert
8 Side edge
9 Side edge
10 Horizontal plane
11 Subsection
12 Subsection
14 Top cutlery basket edge
15 Swivel joint
16 Means
17 Latching hook
18 Cutout
19 Cutout
20 Actuating surface
21 Shoulder
22 Frame
23 Profile wire
24 Guide means
25 Cutout (groove, slot)
26 Cutout in the guide means
A First position of the profile wire
B Second position of the profile wire

The invention claimed is:

1. A dishwasher comprising:
at least one cutlery basket for accommodating cutlery items in a horizontal position,
wherein the at least one cutlery basket is adjustable at least in sections, and
wherein the at least one cutlery basket includes:
a first subsection having an adjustable clearance height, and
a second subsection having an adjustable clearance height,
wherein a depth of each subsection is configured to range from a maximum depth to a minimum depth,
wherein at least a first portion of each subsection is adjustable in and between the minimum and maximum depths, and a second portion of each subsection is maintained at the maximum depth regardless of the adjustable position of the subsection, and
wherein each of the first and second subsections is positionable in a first position when a base portion is generally horizontal, thereby defining a minimum clearance below the base portion, and a second position in which each subsection is pivoted to form an acute angle with respect to horizontal, thereby defining an increased clearance, relative to the first position, below the base portion.

2. The dishwasher as claimed in claim 1, wherein the adjustable clearance height of the first subsection is adjustable independently of the adjustable clearance height of the second subsection.

3. The dishwasher as claimed in claim 1, wherein the adjustable clearance height of each of the first subsection and the second subsection is adjustable by swiveling the first subsection and the second subsection.

4. The dishwasher as claimed in claim 1, wherein an overall clearance height of the at least one cutlery basket is adjustable.

5. The dishwasher as claimed in claim 1, comprising:

a swivel joint that swivelably connects the first subsection to the second subsection.

6. The dishwasher as claimed in claim 5, wherein the swivel joint is arranged in a base section of the cutlery basket.

7. The dishwasher as claimed in claim 1, wherein the first subsection is mirror-symmetrical with respect to the second subsection.

8. The cutlery basket for a dishwasher as claimed in claim 1.

9. The dishwasher as claimed in claim 1, further comprising a swivel joint about which each subsection is pivotable, the maximum depth being defined between the swivel joint and a top edge of the respective subsection.

10. The dishwasher as claimed in claim 1, further comprising a common swivel joint, wherein each of the first and second subsections being pivotably connected to the common swivel joint.

11. A dishwasher comprising:

at least one cutlery basket for accommodating cutlery items in a horizontal position, wherein the at least one cutlery basket is adjustable at least in sections, and wherein the at least one cutlery basket includes:

a first subsection having an adjustable clearance height, and a second subsection having an adjustable clearance height, wherein a depth of each subsection is configured to range from a maximum depth to a minimum depth, wherein at least a first portion of each subsection is adjustable in and between the minimum and maximum depths, and a second portion of each subsection is maintained at the maximum depth regardless of the adjustable position of the subsection, wherein one of:

the first subsection and the second subsection are independently swivelable about the swivel joint with respect to each other; and the first subsection and the second subsection are jointly swivelable about the swivel joint.

12. The dishwasher as claimed in claim 11, comprising:

at least a second swivel joint arranged in one of a first side edge and a second side edge of the at least one cutlery basket, wherein the first subsection and the second subsection are jointly swivelable about the second swivel joint.

13. The dishwasher as claimed in claim 12, wherein the first subsection and the second subsection are swivelable about the second swivel joint independently relative to the swiveling of the first subsection and the second subsection about the swivel joint.

14. A dishwasher comprising:

at least one cutlery basket for accommodating cutlery items in a horizontal position, wherein the at least one cutlery basket is adjustable at least in sections, and wherein the at least one cutlery basket includes:

a first subsection having an adjustable clearance height, and a second subsection having an adjustable clearance height, wherein the at least one cutlery basket includes a flat insert, wherein the flat insert includes:

a frame; and at least two inserts that are swivelable relative to each other and removable from the frame, wherein the two inserts form the first subsection and the second subsection of a base section of the at least one cutlery basket.

15. The dishwasher as claimed in claim 14, wherein one of the at least two inserts is a wide-meshed strainer insert.

16. The dishwasher as claimed in claim 14, wherein each of the at least two inserts has a wedge-shaped cross-section.

17. The dishwasher as claimed in claim 14, wherein each of the first subsection and the second subsection includes means for fixing each of the first subsection and the second subsection in a predefined operating position.

18. The dishwasher as claimed in claim 14, comprising:

means for fixing each of the first subsection and the second subsection in a predefined operating position.

19. The dishwasher as claimed in claim 14, comprising:

a fixing device that secures each of the first subsection and the second subsection in a predefined operating position.

20. The dishwasher as claimed in claim 19, wherein the fixing device prevents one of the first subsection and the second subsection from being lowered beyond a certain angle.

21. The dishwasher as claimed in claim 19, wherein the fixing device includes a latching hook configured to engage the frame.

22. The dishwasher as claimed in claim 19, wherein the fixing device includes:

a profile wire that is tiltable relative to the at least two inserts; and guiding means on the at least two inserts, wherein the frame supports the profile wire in the predefined operating position of the cutlery basket.

23. The dishwasher as claimed in claim 19, wherein the fixing device secures each of the first subsection and the second subsection in one of a plurality of predefined operating positions, wherein the fixing device includes:

a profile wire that is tiltable relative to the at least two inserts; and a guide on the at least two inserts that guides the profile wire, wherein the frame supports the profile wire in one of the plurality of predefined operating positions of the cutlery basket.

24. A dishwasher comprising:

at least one cutlery basket for accommodating cutlery items in a horizontal position, wherein the at least one cutlery basket is adjustable, and wherein a depth of said basket is configured to range from a maximum depth to a minimum depth, wherein at least a first portion of said basket is adjustable in and between the minimum and maximum depths, and a second portion is maintained at the maximum depth regardless of the adjustable position of the basket, wherein the basket is positionable in a first position when a base portion is generally horizontal, thereby defining a minimum clearance below the base portion, and a second position in which the basket is pivoted to form an acute angle with respect to horizontal, thereby defining an increased clearance, relative to the first position, below the base portion.

25. The dishwasher as claimed in claim 24, further comprising a swivel joint about which the basket is pivotable, the maximum depth being defined between the swivel joint and a top edge of the basket.

26. A dishwasher comprising:

at least one cutlery basket for accommodating cutlery items in a horizontal position, wherein the at least one cutlery basket is adjustable, and wherein a depth of said basket is configured to range from a maximum depth to a minimum depth, wherein at least a first portion of said basket is adjustable in and between the minimum and maximum depths, and a second portion is maintained at the maximum depth regardless of the adjustable position of the basket, wherein the basket is movable to a position in which its base portion is provided at an angle relative to horizontal, such that the cutlery items are angled towards a center of the dishwasher.

* * * * *